US005488919A

United States Patent [19]

Ferreiro et al.

[11] Patent Number: 5,488,919

[45] Date of Patent: Feb. 6, 1996

[54] CANTED RUDDER SYSTEM FOR PITCH ROLL AND STEERING CONTROL

[75] Inventors: Larrie D. Ferreiro, Fairfax, Va.; Timothy C. Smith, Gaithersburg; William L. Thomas, III, Hanover, both of Md.

[73] Assignee: The United States of America as represented by the Secretary of the Navy, Washington, D.C.

[21] Appl. No.: 492,560

[22] Filed: Jun. 20, 1995

[51] Int. Cl.[6] ..... B63B 39/00

[52] U.S. Cl. ..... 114/122; 114/126; 114/163

[58] Field of Search ..... 114/144 R, 144 E, 114/144 B, 146, 162, 163, 121, 122, 126

[56] References Cited

U.S. PATENT DOCUMENTS

| | | | |
|---|---|---|---|
| 3,931,781 | 1/1976 | Larsh | 114/126 |
| 4,023,516 | 5/1977 | Bennett | 114/126 |
| 4,380,206 | 4/1983 | Baitis et al. | 114/122 |
| 4,388,889 | 6/1983 | Baitis et al. | 114/144 E |
| 4,398,486 | 8/1983 | Woolaver et al. | 114/144 R |
| 5,415,122 | 5/1995 | Shen | 114/162 |

OTHER PUBLICATIONS

Ferreiro, Larrie D., Timothy C. Smith, William L. Thomas, III and Roberto Macedo, "Pitch Stabilization for Surface Combatants," Naval Engineers Journal, vol. 106, No. 4, Jul. 1994, pp. 174–191.

*Primary Examiner*—Stephen Avila

*Attorney, Agent, or Firm*—Gary G. Borda

[57] ABSTRACT

The invention is directed to a system for stabilizing a marine vehicle against rolling and pitching motions and for providing steering control to the marine vehicle. The system includes at least two rudders rotatably affixed to the marine vehicle aft of marine vehicle propellers and canted approximately 45° to the vertical; at least two rudder actuators, one actuator associated with each of the rudders, for providing a predetermined dynamic rotational motion to each rudder; at least one power unit for providing power to the rudder actuators; and a control unit for determining the predetermined dynamic rotation of each of the rudders and for generating control signals corresponding thereto. The control signals are provided to the at least one power unit for regulating the power provided to the actuator units wherein the control unit independently controls the movement of each of the rudders such that the rudders cooperate to provide steering control to the marine vehicle and to stabilize the marine vehicle against rolling and pitching motions.

19 Claims, 5 Drawing Sheets

CANTED RUDDER SYSTEM FOR PITCH ROLL AND STEERING CONTROL

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to a device for controlling pitch and roll motions of marine vehicles and, more particularly, to a dynamic control system for stabilizing pitch and roll motions, as well as for providing steering, using a single set of control surfaces, thus, minimizing impact on the ship design in terms of size, resistance, and cost.

2. Brief Description of Related Art

Pitching is one of the most damaging motions for a ship. With respect to Naval combatant vessels, ship pitching motion detrimentally affects combatant operations in many ways. Vertical motions and accelerations can reduce the effectiveness of bow-mounted sonars as well as towed arrays. Slamming of the bow dome causes local distortions and damage. Angular acceleration affects the performance of radars and weapons, and can cause misalignment through hull flexure. Motion-induced added resistance and keel slamming cause involuntary speed reductions and may necessitate voluntary speed reductions to reduce damage. Emergence of propellers and rudders in following seas result in propeller racing and loss of steerage. Keel and bow flare slamming cause structural vibrations that can damage the hull and equipment. Spray generation reduces visibility and increases topside icing in cold weather. Vertical accelerations affect crew performance through seasickness, loss of balance and injury. Accordingly, there is a present need to improve ship operability (e.g., percent of time the ship is operable to perform its combat mission) by reducing pitching motion. However, since the introduction of anti-roll fins in the 1940's, and rudder-roll stabilization in the 1970's, roll reduction serves as the primary means to improve operability.

Attempts at pitch stabilization began soon after the introduction of roll stabilization in the 1860's, with the majority of efforts being undertaken this century. However, all past attempts have either been unsuccessful due to undesirable peripheral effects such as vibration, or involve greatly increased complexities and costs in the ship design and operation. The requirements for pitch stabilization devices are somewhat different than those required for roll stabilization. The enormous moments generated in pitching, often over fifty times the roll moment, require that pitch stabilization devices generate equally large counteracting moments. For surface combatants, pitch periods are typically half those of roll periods (5–7 seconds for pitch as compared to 10–15 seconds for roll), so any anti-pitch device requires a quick reaction time. Moreover, pitch motions are excited over a much wider frequency range than roll motions, thus precluding stabilization methods that are only effective at certain frequencies. Consequently, such motion control devices as gyroscopes and tanks are not suitable as anti-pitch devices. Gyroscopic system would require massive flywheels to counter pitching moments. Passive internal tanks are generally highly tuned making them ineffective at off-design frequencies, whereas active tanks would require such a fast flow of immense amounts of water as to make them impractical. Consequently, all feasible attempts at reducing pitch have involved some form of bow or stern foil or a combination of the two. The restoring force generated by fins is speed dependent. Moreover, the pitch restoring force can be as much as five times greater than typical roll restoring forces, so pitch stabilization foils must be bigger and more rugged than conventional anti-roll fins. The cost of added appendages is an associated increase in resistance.

Bow fins can be placed on the hull or fixed to a strut below the keel. Bow fins have the greatest effect on pitching because the relative motion between the ship and the wave is greatest at the bow. However, bow fins have problems with ventilation, cavitation and vibration that preclude their viability. Fixed bow fins develop very large angles of attack, which increases ship resistance and can cause vibration due to cavitation and ventilation. To effectively reduce cavitation, active bow fins must operate continuously. If strut mounted, actuation can prove difficult. Stern fins are generally mounted forward of the propeller and may be fixed or active. Stern fins have less relative velocity than bow fins and, therefore, do not reduce pitch as well. In addition, the moment arm is shorter than for bow fins, because the pitch center is generally aft of amidships, further reducing stern fin effectiveness. In experimental studies it has been found that fixed stern fins have little affect on pitch, can actually increase heave, and increase drag considerably. Active stern fins show more promise, but still result in increased cost and complexity due to added systems as well as increasing resistance considerably.

In addition to adding appendages, substantial seakeeping improvements have been made in recent years through optimizing hull form design. However, there appears to be a limit to the degree of improvement using this approach. Increasing a ship's length improves its pitch performance by increasing its rotational inertia, thus, requiring waves of longer wavelengths to excite it. Since longer waves occur less frequently in nature, operability increases. However, increasing the length of a ship is expensive in terms of weight and cost, so factors other than seakeeping generally drive a design towards the shortest possible length.

Small waterplane area twin hull (SWATH) ships are well-known as good seakeeping hullforms. However, compared with an identical-payload monohull, a SWATH is considerably heavier and usually slower for the same horsepower. Surface combatants are required to operate at comparatively high speeds, where the resistance penalties of a SWATH are perceived to be a disadvantage. Additionally, because a SWATH has a smaller longitudinal waterplane inertia than a comparable monohull, it take less moment to cause pitching motion. As a result, both bov and stern foils are required for pitch stability.

There is a need to improve seakeeping qualities of large, high speed ocean-going vessels such as surface combatants. "Better" hull designs are not sufficient. Both longer hulls and SWATH's dramatically increase costs. Added appendages increase resistance and add design complexity resulting in increased costs over the life of the ship. Consequently, there is a long felt but unsolved need for an economical system for stabilizing pitch motions for existing and future monohull combatant and other high speed ship designs. More specifically, there is a need to stabilize both roll and pitch without adding additional systems, such as bow or stern foils, and without drastically increasing the cost of the ship.

SUMMARY OF THE INVENTION

Accordingly, it is an object of the present invention to provide a means to stabilize marine vessels against wave and wind induced pitching and rolling motions without adding extra systems to the ship and without causing the adverse effects mentioned above.

It is a further object of the present invention to provide an economical means of improving seakeeping and operability of large, high speed, oceangoing monohull vessels such as surface combatants.

It is still a further object of the present invention to provide a single system coupled with the ship rudders for actively stabilizing both rolling and pitching motions as well as for providing steering control.

Other objects and advantages of the present invention will become apparent to those skilled in the art upon a reading of the following detailed description taken in conjunction with the drawings and the claims supported thereby.

In accordance with the present invention, a system for stabilizing a marine vehicle against rolling and pitching motions and for providing steering control to the marine vehicle is provided. The system includes at least two rudders rotatably affixed to the marine vehicle aft of the vehicle propellers, each of the rudders canted approximately 45° to the vertical; at least two rudder actuators, one actuator associated with each of the rudders for providing a predetermined dynamic rotation to the rudder; at least one power unit for providing power to the rudder actuators; and a control unit for determining the predetermined dynamic rotation of each of the rudders and for generating control signals corresponding thereto. The control signals are provided to the at least one power unit for regulating the power provided to the actuator units. The control unit independently controls the dynamic rotation of each of the rudders such that the dynamic rotations of the rudders cooperate to stabilize the marine vehicle against rolling and pitching motions as well as to provide steering control to the marine vehicle.

In an alternative embodiment, the present invention includes port and starboard rudders, first and second rudder actuators, first and second power units, and a control unit. The port rudder is mounted on a rudder stock rotatably affixed to the marine vehicle aft of a port propeller and is canted approximately 45° to the vertical. The starboard rudder is mounted on a rudder stock rotatably affixed to the marine vehicle aft of a starboard propeller and is canted approximately 45° to the vertical. The port and starboard rudders are canted downward from the waterline and outward from vehicle longitudinal centerline so as to have mutually opposite slopes. The first rudder actuator, which is mounted inside the marine vehicle, is coupled to the port rudder stock and functions to provide a predetermined dynamic rotation to the port rudder. The second rudder actuator, which is mounted inside the marine vehicle, is coupled to the starboard rudder stock and functions to provide a predetermined dynamic rotation to the starboard rudder. Both the first and second power units are connected to both of the first and second rudder actuators and each power unit may provide power to one or both of the first and second rudder actuators. The control unit determines the dynamic rotation of the port and starboard rudders necessary to both steer the ship at its required heading and stabilize the ship against rolling and pitching motions. The control unit controls the dynamic rotation of the rudders by generating control signals that are selectively provided to the power units for regulating the power provided to the actuator units.

Accordingly, the control unit independently controls the dynamic rotation of the port and starboard rudders such that the port and starboard rudders cooperate to provide steering control to the marine vehicle and to stabilize the marine vehicle against rolling and pitching motions.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
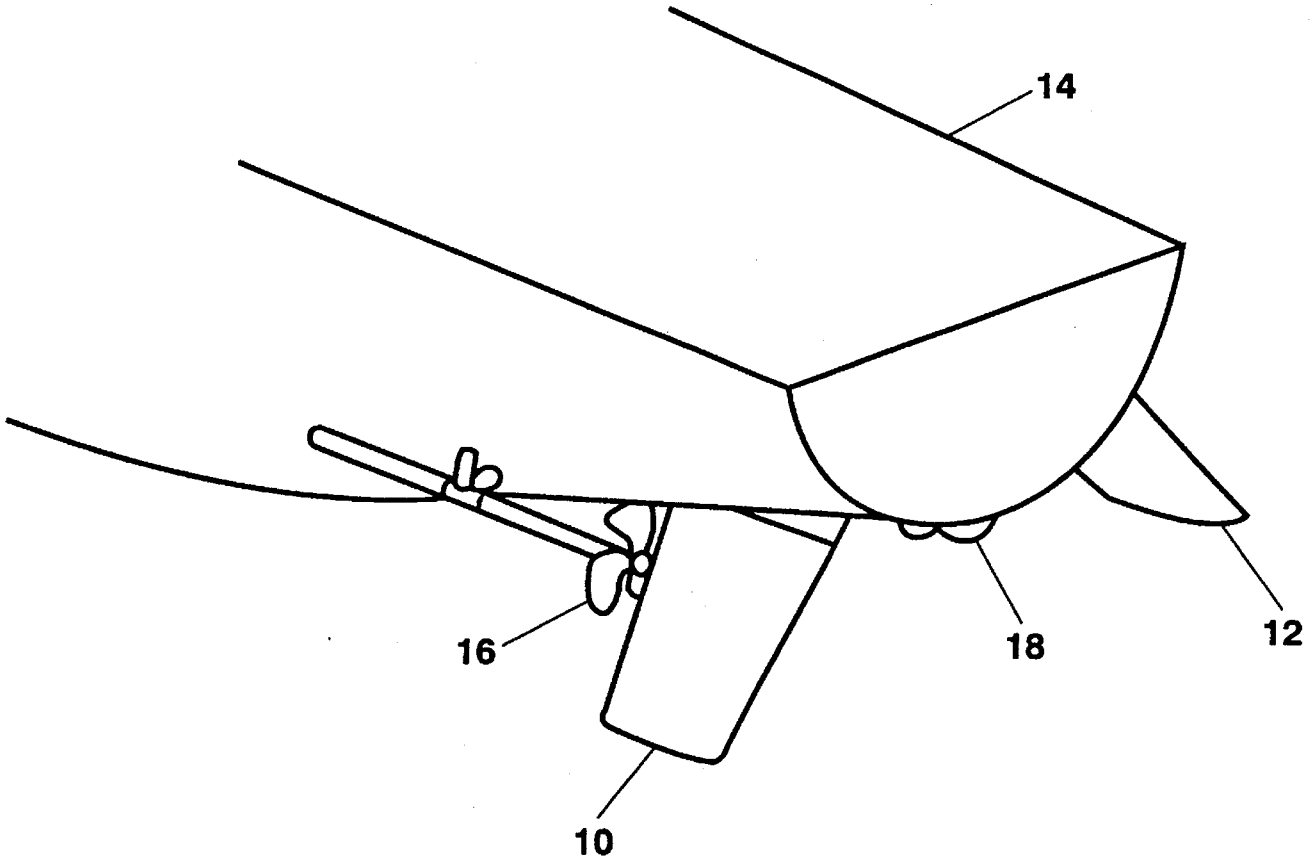
FIG. 1 is a perspective view of the canted rudders of the present invention mounted behind the propellers of a typical surface combatant hullform.
Figure 2:
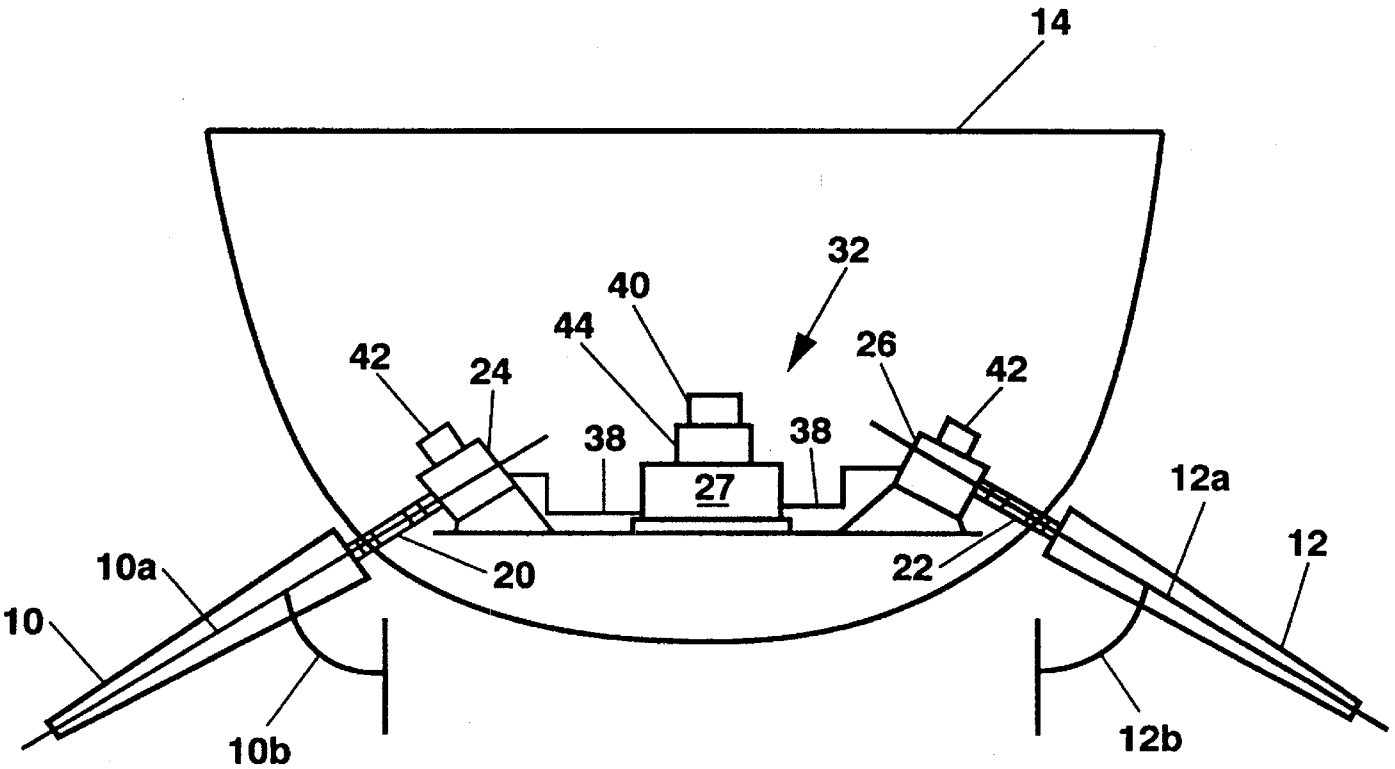
FIG. 2 is a schematic drawing of one embodiment of the system for controlling pitch, roll and steering in accordance with the present invention.

Referring now to the drawings, and particularly to FIGS. 1 and 2, the system for stabilizing a marine vehicle against rolling and pitching motions and for providing steering control to the marine vehicle in accordance with the present invention is shown. The system generally includes at least two rudders 10 and 12 rotatably affixed to the marine vehicle 14, at least two rudder actuators 24 and 26 for providing independent rotational motion to rudders 10 and 12, at least one power unit 27 for providing power to rudder actuators 24 and 26, and a control unit 32 for independently controlling rudder motions as a function of the dynamic response of vehicle 14 to wind, waves and rudder forces. Although the present invention is applicable to all marine vehicles that require added stability in both the horizontal and vertical planes, marine vehicle 14 is preferably a large, high speed ocean-going vessel such as a Naval surface combatant. The characteristics of such hullforms are well known in the art and will not be discussed in detail herein.

Rudders 10 and 12 are mounted to the stern of marine vehicle 14 aft of propellers 16 and 18 and are, thus, located in accelerated flow in the propeller wake. Generally, there will be an even number of rudders with their placement on the vehicle hull being symmetric with respect to longitudinal centerline 15 of marine vehicle 14. Each rudder has an actuator associated therewith to provide rudder movement, in the form of a predetermined dynamic rotation, to drive each rudder to a desired or attainable angular position (rudder angle) as more fully described below. Control unit 32 determines the predetermined dynamic rotation of each of the at least two rudders and generates control signals corresponding thereto. Control signals are provided to power unit 27 for independently regulating power provided by power unit 27 to the individual actuator units 24 and 26. Thus, control unit 32 independently regulates the dynamic rotation of each rudder such that rudders 10 and 12 generate forces and moments that cooperate to stabilize the marine vehicle against rolling and pitching motions and maintain the marine vehicle on its intended course. A theoretical study of the effectiveness of a canted rudder system for pitch stabilization of surface combatants has been performed by the inventors and is presented in: Ferreiro, Larrie D., Timothy C. Smith, William L. Thomas III and Roberto Macedo, "Pitch Stabilization for Surface Combatants," Naval Engineers Journal, Vol. 106, No. 4, Jul. 1994, pp. 174–191, incorporated herein by reference.

Figure 3:
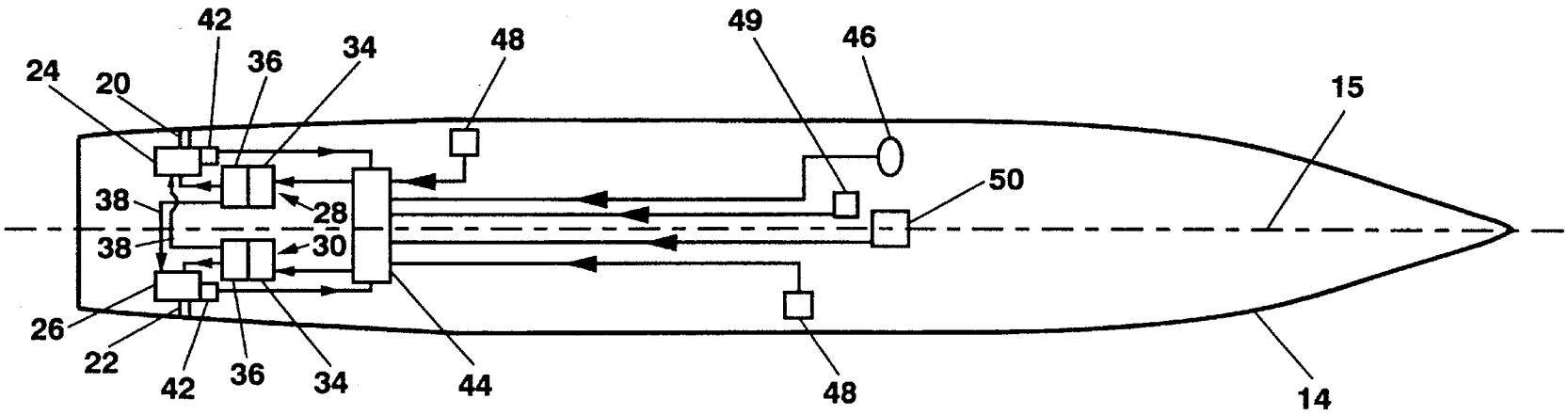
FIG. 3 is a schematic drawing of an alternative embodiment of system for controlling pitch, roll and steering in accordance with the present invention.

FIG. 1 depicts a preferred embodiment wherein port and starboard rudders, 10 and 12, are mounted for rotation on marine vehicle 14 aft of port and starboard propellers, 16 and 18. As shown in FIGS. 2 and 3, port rudder 10 is rigidly attached to port rudder stock 20 that is rotatably affixed to marine vehicle 14. Starboard rudder 12 is rigidly attached to starboard rudder stock 22 that is rotatably affixed to marine vehicle 14. Rudders 10 and 12 are canted downward from the waterline and outward from longitudinal centerline 15. Port and starboard rudders 10 and 12 define rudder planes 10*a* and 12*a*, respectively. Rudder planes 10*a* and 12*a* define cant angles 10*b* and 12*b* such that port and starboard rudders 10 and 12 have mutually opposite slopes. Preferably, cant angles 10*b* and 12*b* are approximately 45° relative to the vertical. First rudder actuator 24 is mounted within marine vehicle 14 and is coupled to port rudder stock 20 for providing a predetermined dynamic rotation to port rudder 10. Second rudder actuator 26 is mounted within marine vehicle 14 and is coupled to starboard rudder stock 22 for providing a predetermined dynamic rotation to starboard rudder 12. First power unit 28 may be connected to both first and second rudder actuators 24 and 26 for selectively providing power to one or both of first and second rudder actuators 24 and 26. Second power unit 30 may be connected to both first and second rudder actuators 24 and 26 for selectively providing power to one or both of first and second rudder actuators 24 and 26. Control unit 32 is in electrical communication with first and second power units 28 and 30 for selectively providing port and starboard control signals (representing the predetermined dynamic rotation of the port and starboard rudders, respectively) to first and second power units 28 and 30. For example, control unit 32 may provide a port control signal to either one or both of first and second power units 28 and 30 as required to control port rudder 10. Additionally, control unit 32 may provide a starboard control signal to either one or both of first and second power units 28 and 30 as required to control starboard rudder 12. Accordingly, control unit 32 may independently regulate power provided by power units 28 and 30 to port and starboard actuator units 24 and 26 to control the dynamic rotation of port and starboard rudders 10 and 12.

Port and starboard rudders 10 and 12 may be any suitable rudder for providing dynamic control to a marine vehicle. Preferably, rudders 10 and 12 are balanced spade rudders. The area, profile, and cross-section of rudders 10 and 12 are determined through an analysis of lift, drag and structural rigidity derived from maneuverability and stabilization requirements of the particular applications, using well known methods for designing rudders in use today. Rudders 10 and 12 are connected to actuators 24 and 26 by rudder stocks 20 and 22 that are supported on bearings designed to transmit the rudder generated forces to the marine vehicle hull. Because rudders 10 and 12 are canted at approximately 45° to the vertical, they generate a lift force that can be resolved into vertical and horizontal components, thus, giving them the ability to control pitch (vertical plane motion) as well as roll and steering (horizontal plane motions). The vertical and horizontal forces generate pitch and roll moments, respectively, due to the lever arm between the rudder center of pressure and the vehicle center of gravity. Generally, the port and starboard rudders turn in the same direction (e.g., all rudders rotated in a trailing edge down direction) to control pitch and in opposite direction (e.g., port rudder(s) rotated in a trailing edge down direction, starboard rudder(s) rotated in a trailing edge up direction) to control roll and yaw. Horizontal lift developed by rudders 10 and 12 will control steering and roll, while vertical lift will control pitch. By applying differential incidence angles to the port and starboard rudders, pitch, roll and yaw may be controlled. Thus, at any particular time, the port and starboard rudders may have the same or different rudder angles.

Figures 4A, 4B, 4C:
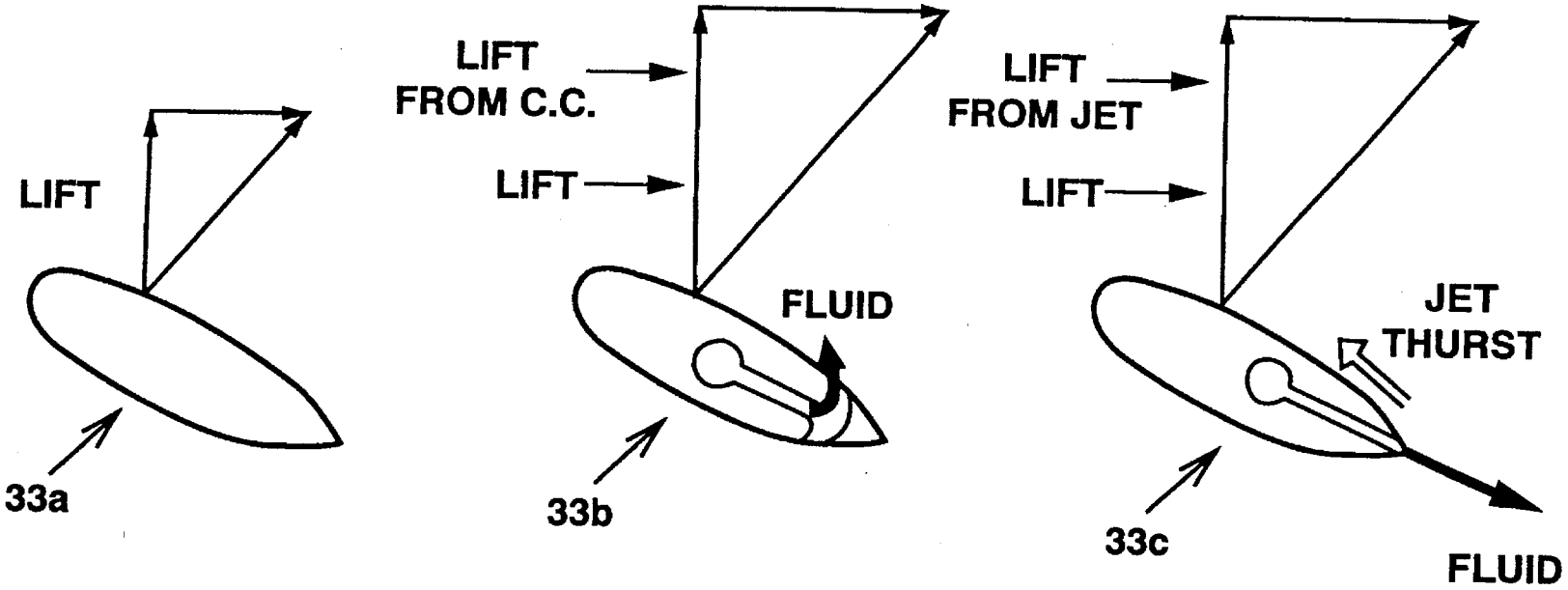
FIGS. 4*a*, 4*b* and 4*c* present alternative embodiments of the canted rudders of the present invention.

Since rudders 10 and 12 are located behind the propellers, they use the propeller wake to generate increased lift. Additionally, rudders 10 and 12 may be high lift foils such as circulation control foils or jet flap foils. High lift foils can develop the large forces required to stabilize pitch using a smaller rudder area. Referring to FIG. 4, conventional foil 33*a* develops lift based solely on speed and angle of incidence. Circulation control foil 33*b* develops additional lift based on the Coanda effect. A thin jet of fluid is emitted on the upper surface, which adheres to the trailing edge region and moves the stagnation point to the foil's lower surface, increasing the pressure on the lower surface, resulting in greater lift. Jet flap foil 33*c* pumps fluid from a slit in the trailing edge to develop additional lift. The additional lift developed by these high lift foils is dependent on the amount of fluid pumped and can be two to four times the lift of a conventional foil. These devices are well known in the art and will not be further described herein.

Rudder actuators 24 and 26 may be any of the well known actuators for providing rotational motion to rudders 10 and 12. However, in a preferred embodiment, rudder actuators 24 and 26 are electrohydraulic rotary-vane steering gear actuators consisting of limited-travel vane actuators connected directly to rudder stocks 20 and 22. Actuators 24 and 26 may rotate each rudder up to about 35° to port and starboard. For surface combatants, pitch periods are typically half those of roll periods (5–7 seconds for pitch as compared to 10–15 seconds for roll) while yaw response to rudder movement is typically on the order of 20–40 seconds. Thus, the period of rudder oscillation required to control pitch and roll is too short to greatly affect the yaw response of the ship. Consequently, actuators 24 and 26 must oscillate rudders 10 and 12 at periods that affect pitch and roll without leaving the rudders deflected long enough to create an undesirable yaw angle. Generally, the rate of rudder rotation (in degrees/second) will be a constant and will be set at the highest rate that is available from actuators 24 and 26 (taking into account the avoidances of ventilation and cavitation). An appropriate rudder rotation rate has been found to be between approximately 15°/sec to 25°/sec. The particular actuators chosen by the system designer must, therefore, have a fast response rate and must be adequate to develop the torque required to overcome forces and moments acting on rudders 10 and 12 and to generate the stabilizing forces and moments necessary to stabilize marine vehicle 14. The estimation of forces acting on and generated by rudders 10 and 12, based on the particular ship and rudder size, anticipated mission, and areas of operation, is well within the skill of the art and will not be addressed in detail herein.

In a preferred embodiment, power units, 28 and 30, each include an electric servo-motor 34 and a variable capacity hydraulic oil pump 36 driven by electric servo-motor 34. Hydraulic oil pumps 36 are in flow communication with actuators 24 and 26 by way of hydraulic lines 38 to provide a flow of hydraulic oil to rudder actuators 24 and 26. Each power unit 28 and 30 may be connected to one or both of rudder actuators 24 and 26. Consequently, each power unit 28 and 30 is capable of controlling hydraulic oil flow to one or both of rudder actuators 24 and 26. By providing redundancy, the vehicle maintains steering control even if one power unit or one actuator is disabled. The control signals provided by control unit 32 are sent to electric servo-motors 34 for regulating the flow of hydraulic oil provided by hydraulic oil pumps 36 to to rudder actuators 24 and 26. The size and flow rates of power units 28 and 30 are determined based on anticipated turning and stabilizing moments, angular displacement, velocity and accelerations required of rudders 10 and 12.

In a preferred embodiment, control unit 32 includes: means 40 for ascertaining marine vehicle dynamic motion data and for generating signals corresponding thereto; means 42 for measuring rudder angular position and for generating signals corresponding thereto; and controller 44 for receiving a required heading signal and the signals from ascertaining means 40 and measuring means 42. Controller 44 generates port and starboard control signals in response to the received signals. Controller 44 may be an analog controller or may be a special purpose or general purpose digital computer. Ascertaining means 40 include means 46 for determining sway amplitude and sway rate, motion sensors 48 for determining vehicle pitch angle and pitch rate, roll angle and roll rate, and yaw angle and yaw rate (i.e., vehicle heading and rate of turn), and may include a separate means 49 for determining vehicle yaw (heading). Means 46 for determining sway amplitude and sway rate is preferably a Global Positioning Satellite (GPS) system data receiver installed on vehicle 14 for receiving latitude, longitude, course and speed from a GPS. Appropriate motion sensors 48 for determining pitch angle and rate, roll angle and rate, and yaw angle and rate (heading and rate of turn) include gyroscopes, accelerometers, e.g., three-axis accelerometers, Watson meters, and combinations thereof. Separate means 49 for determining vehicle yaw angle (heading) may be a compass, such as a flux gate compass. As stated above, the preferred application of the present invention is on Naval surface combatants which typically include inertial navigation system such as, for example, an AN/WSN-5 navigation system as provided on USN combatants. Thus, means 40 for ascertaining marine vehicle dynamic motion data may take the form an inertial navigation systems. Inertial navigation systems are well known in the art and will not be described in detail herein. Since roll and pitch rate measurements are important in determining the predetermined dynamic rudder rotation, individual roll and pitch rate sensors may supplement the system to improve system performance. Means 42 for measuring rudder angular position may be any well known means for measuring angular position and/or rotation rate, such as linear or angular potentiometers.

Control unit 32 may further be capable of selectively determining the dynamic rotation based on (1) rates and angles of pitch, roll and yaw, rate and amplitude of sway, and required heading, (b) rates and angles of pitch and yaw, rate and amplitude of sway, and required heading (i.e., roll disregarded), or (c) rates and angles of roll and yaw, rate and amplitude of sway, and required heading (i.e., pitch disregarded). For example, a manual override 50 may be connected to control unit 32 to allow an operator of marine vehicle 14 to selectively disengage the roll or pitch control portions of the system.

The present invention may further include a means for the operator of marine vehicle 14 to control the dynamic rotation of rudders 10 and 12 independent of the system or in cooperation with the system. For example, manual override 50 may allow the operator to disengage the system and control the rudders independently. The manual override may further allow the operator to temporarily interrupt the system and control rudder movement periodically while the system remains in operation.

Figure 5:
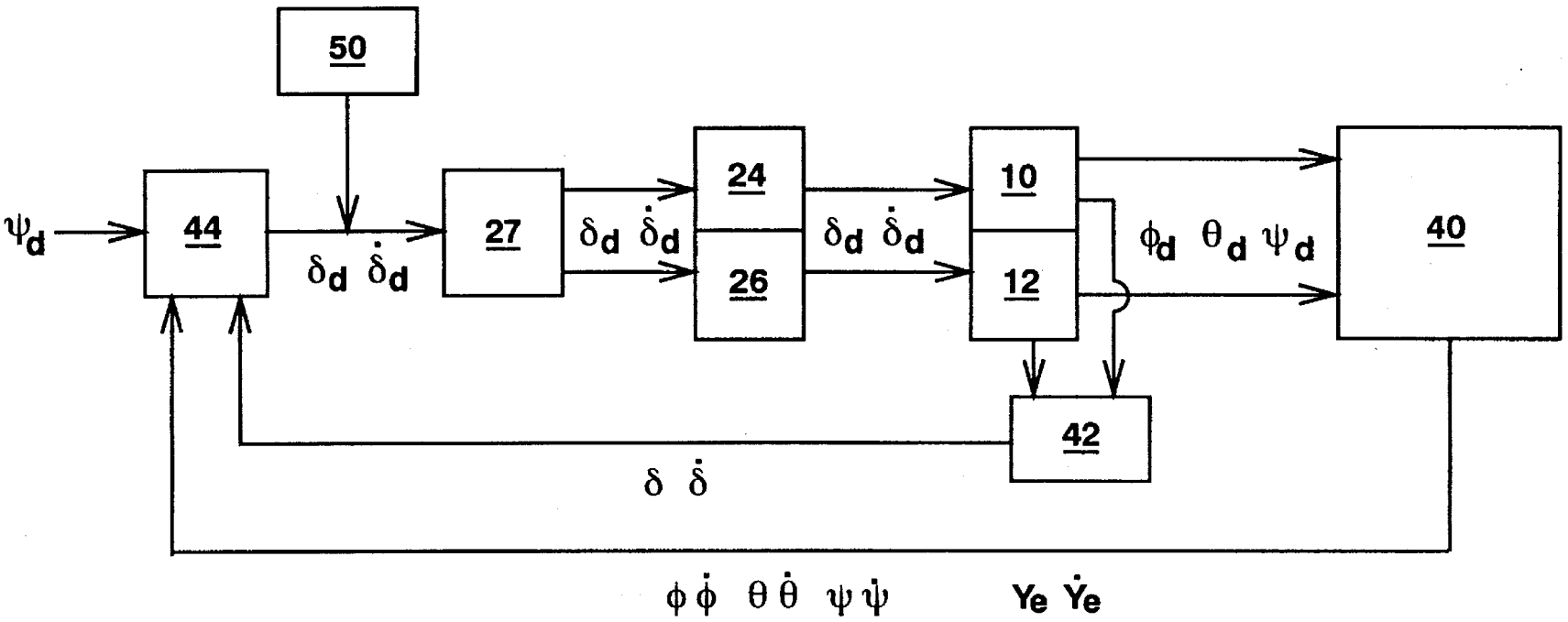
FIG. 5 is a system control diagram in accordance with the present invention.

As depicted in FIG. 5, controller 44, ascertaining means 40, and measuring means 42 form a feedback loop for determining and regulating the desired dynamic rotation (desired rudder angle and rate of rotation) of rudders 10 and 12 as a function of the rates and angles of pitch, roll and yaw, the rate and amplitude of sway, and the required heading. For example, controller 44 receives desired ship heading from a ship operator, dynamic motion data from ascertaining means 40, and rudder angle data from measuring means 42. Discrete data points may be measured and transmitted over time at a specified sample rate or data may be measured and transmitted continuously. Based on the received data, controller 44 determines the desired dynamic rotation of port and starboard rudders 10 and 12 for reducing rolling and pitching motions and for steering the ship on the desired heading. Controller 44 generates control signals corresponding to the desired dynamic rudder rotation and transmits the control signals to power units 28 and 30, Power units 28 and 30 regulates the power transmitted to actuators 24 and 26 for actuating rudders 10 and 12 in accordance with the control signals. As rudders 10 and 12 respond to the control signals, they develop lift forces dependent upon the particular rudder angle and vehicle speed. The vertical and horizontal components of the lift force affect the dynamics of marine vehicle 14. The resulting ship motions are again determined by ascertaining means 40 and updated dynamic motion data and rudder angle data are transmitted to controller 44 which modifies the control signals in the next iteration of the feedback loop. Due to mechanical limits (e.g., available rudder deflection), the desired rudder angle and/or desired rotation rate may not be attainable. Thus, the rudder(s) will be moved to the attainable rudder angle, the motions will be stabilized accordingly, and new data will be collected and transmitted to controller 44. The desired rudder angle is updated frequently, e.g., at least once every sampling period. As stated above, the rudder rotation rate is generally held constant, however, the rate may be varied so that the desired or maximum attainable rudder angle is achieved within one sampling period.

Controller 44 receives vehicle dynamic motion data from ascertaining means 40 and determines the dynamic rotation of the rudders (desired rudder angle and rate of rotation) that will reduce the ship's rolling and pitching motions. The desired rudder angles are continuously or periodically calculated, as part of the feedback loop, to correct for deviations in the ship's response to preceding rudder input. Preferably, the controller used is a Proportional- Integral-Derivative (PID) controller similar to those employed in rudder roll stabilization systems. Controller 44 determines the desired rudder angles based on sway, roll, pitch, and yaw, using the following control law equations:

$$\delta_{dY}=-C_{YI}\int(Y_e-Y_{ed})dt-C_{YP}(Y_e-Y_{ed})-C_{YD}\dot{Y}_e$$

rudder angle as a function of sway amplitude and rate;

$$\delta_{d\phi}=C_{\phi I}\int(\phi-\phi_d)dt-C_{\phi P}(\phi-\phi_d)-C_{\phi D}\phi$$

rudder angle as a function of roll angle and rate;

$$\delta_{d\theta}=-C_{\theta I}\int(\theta-\theta_d)dt-C_{\theta P}(\theta-\theta_d)-C_{\theta D}\theta$$

rudder angle as a function of pitch angle and rate;

$$\delta_{d\psi}=-C_{\psi I}\int(\psi-\psi_d)dt-C_{\psi P}(\psi-\psi_d)-C_{\psi D}\psi$$

rudder angle as a function of yaw angle and rate; and $$\delta_d=\delta_{dY}+\delta_{d\phi}+\delta_{d\theta}+\delta_{d\psi}$$

desired rudder angle.

In the foregoing equations, $Y_e$ is earth referenced sway as ascertained from the GPS system (amplitude or rate as appropriate); $\phi$ is roll (angle or rate as appropriate); $\theta$ is pitch (angle or rate as appropriate); $\psi$ is yaw (angle or rate as appropriate); and $\delta$ is rudder angle. Symbols without subscripts indicate actual values measured by ascertaining means 40 while symbols having the subscript d indicate the desired values of rudder angle, sway, roll, pitch, and yaw. The essence of the control law equations is to reduce the difference between the desired values and the measured values. The individual equations as a function of sway, roll, pitch and yaw are summed to determine the desired rudder angles. The predetermined dynamic rudder rotation is based on the desired rudder angles as a function of time (i.e., desired rudder angles are periodically or continuously updated and control signals corresponding thereto are periodically or continuously transmitted to the power units). Individual terms in the equations may be positive or negative depending on location (port or starboard) and heading of the ship and, thus, the port and starboard rudder rotation may in the same or opposite directions.

The coefficients or gains ($C_Y$, $C_\phi$, $C_\theta$, and $C_\psi$) used in the equations determine the performance of the system. The P, I, and D subscripts refer to the particular term of the PID controller to which the coefficients belong. The potential (P) and derivative (D) terms of the equations control the displacement and velocity deviations, whereas, the integrative (I) term controls the slow acting drift motion. The coefficients may be constants determined based on either a "most likely" or a "worst case" condition. In this case, performance will suffer at other conditions. Further, the coefficients are determined such that rudder stall angle is not exceeded and cavitation is avoided. Alternatively, the coefficients may be optimally determined using adaptive control logic based on changing ship response, speed, and heading. Algorithms for adaptive control logic weigh the importance of reducing rolling or pitching motions based on operational guidelines and ship system operability requirements. Modifying gains during operation allows the system to maintain efficiency and lowest motions in a changing seaway and during course changes.

With rudder roll stabilization, the coefficients are chosen such that roll reduction does not adversely affect steering. Likewise, control unit 32 includes an adaptive control logic for placing priority on steering control when determining the dynamic rudder rotation to ensure that there is no interference with the primary function of steering. Moreover, when rolling and pitching motions are of substantially equivalent magnitudes, the control logic selects which of the motions to stabilize. The selection is generally based on maintaining directional control and optimum stability in the vertical and horizontal planes, taking into account environmental and/or operational conditions (e.g., heading relative to predominant direction of wave, predominant wave period, operational mode ship is presently performing), such that the most damaging motions are avoided. In the present invention, coefficients will be chosen such that pitch reduction does not adversely affect steering or roll reduction. Fortunately, conditions of large rolling do not typically correspond to conditions of large pitching. Thus, the coefficients may be chosen to predominantly reduce either roll or pitch as appropriate, i.e, depending on environmental and/or operational conditions experienced at the moment. Coefficients are generally determined by the skilled system designer based on experience and may be refined during sea trials. The determination of PID coefficients is well known in the art and will not be described in detail herein.

Unless there is a static heel or trim, the integrative terms for roll and pitch are zero. The potential term for roll and pitch are generally referenced to zero mean or zero desired angle. Thus, the equations for roll and pitch become:

$$\delta_{d\phi}=C_{\phi P}\phi-C_{\phi D}\phi$$

and $$\delta_{d\theta}=C_{\theta P}\theta-C_{\theta D}\theta$$

These controller equations are for time domain analysis which corresponds most closely to actual ship installation. Frequency domain analysis is also possible using other similar control law equations.

As stated earlier, the vertical and horizontal forces produced by canted rudders 10 and 12 generate pitch and roll moments. To stabilize marine vehicle 14 against rolling and pitching motions, the pitch and roll moments must be generated out of phase with the wind and wave excitation so that they reduce pitching and rolling motions. The vehicle responses can be reduced without undue interaction between roll and pitch, provided the natural frequencies of roll and pitch are far enough apart. The closer the periods, the more the interaction between stabilizing moments, e.g., stabilizing pitch moment affecting roll. The adaptive control logic can be used to prevent stabilizing moment interactions when natural periods of roll and pitch are similar.

The advantages of the present invention are numerous. The present invention provides a single set of control surfaces to actively control both roll and pitch motions, as well as providing the steering function for marine vessels such as surface combatants. Consequently, pitch and roll are stabilized, and detrimental effects are reduced or eliminated, without significantly increasing ship cost and without adding additional appendages to the ship, such as bow or stern foils. Seakeeping is improved and ship operability is increased with minimal impact on the ship design in terms of size, resistance, and cost.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A system for stabilizing a marine vehicle against rolling and pitching motions and for providing steering control to the marine vehicle, comprising:

at least two rudders rotatably affixed to the marine vehicle aft of a marine vehicle propeller, each of said at least two rudders canted approximately 45° to the vertical;

at least two rudder actuators, one actuator associated with each of said at least two rudders for providing a predetermined dynamic rotation to said rudder;

at least one power unit for providing power to said at least two rudder actuators; and a control unit for determining said predetermined dynamic rotation of each of said at least two rudders and for generating control signals corresponding thereto, said control signals being provided to said at least one power unit for regulating said power provided to said actuator units wherein said control unit independently controls said dynamic rotation of each of said at least two rudders such that said dynamic rotations of said at least two rudders cooperate to stabilize the marine vehicle against rolling and pitching motions and to provide steering control to the marine vehicle.

2. A system as in claim 1 wherein the at least two rudders comprise one port rudder and one starboard rudder, each of said rudders defining a rudder plane, each of said rudders canted downwardly and outwardly wherein said rudder planes have mutually opposite slopes.

3. A system as in claim 1 wherein said at least two rudders are balanced spade rudders.

4. A system as in claim 3 wherein said at least two rudders are chosen from the group consisting of circulation control foils and jet flap foils.

5. A system as in claim 1 wherein said at least two rudder actuators are electrohydraulic rotary-vane steering gear actuators.

6. A system as in claim 1 wherein said at least one power unit includes an electric servo-motor and a variable capacity hydraulic oil pump driven by said electric servo-motor, said hydraulic oil pump providing a flow of hydraulic oil to said at least two rudder actuators.

7. A system as in claim 6 wherein said at least one power unit comprises at least two power units, each power unit being connected to each of said at least two rudder actuators wherein each power unit is capable of controlling hydraulic oil flow to from one to all of said at least two rudder actuators.

8. A system as in claim 6 wherein said control signals are provided to said at least one electric servo-motor for regulating said flow of hydraulic oil provided to said at least two rudder actuators.

9. A system as in claim 1 wherein said control unit includes means for ascertaining marine vehicle dynamic motion data and for generating signals corresponding thereto, means for measuring rudder angular position and for generating signals corresponding thereto, and a controller for receiving a required heading signal and said signals from said ascertaining means and said measuring means, said controller generating said control signals in response to said received signals.

10. A system as in claim 9 wherein said means for ascertaining marine vehicle dynamic motion data include means for determining sway amplitude and sway rate, and motion sensors for determining pitch angle and pitch rate, roll angle and roll rate, and yaw angle and yaw rate, and wherein said controller, said ascertaining means, and said measuring means form a feedback loop for determining said dynamic rotation of said at least two rudders as a function of said rates and angles of pitch, roll and yaw, said rate and amplitude of sway, and said required heading.

11. A system as in claim 1 wherein said control unit further includes a control logic functioning to place priority on said steering control during said determining of said dynamic rotation, and wherein when said rolling and pitching motions are of substantially equivalent magnitudes said control logic functions to select which of said motions to stabilize.

12. A system as in claim 1 wherein said control unit is capable of selectively determining said dynamic rotation based on (a) said rates and angles of pitch, roll and yaw, said rate and amplitude of sway, and said required heading, (b) said rates and angles of pitch and yaw, said rate and amplitude of sway, and said required heading, or (c) said rates and angles of roll and yaw, said rate and amplitude of sway, and said required heading.

13. A system as in claim 1 further including a means for an operator to control said dynamic rotation of said at least two rudders independent of said system or in cooperation with said system.

14. A system for stabilizing a marine vehicle against rolling and pitching motions and for providing steering control to the marine vehicle, comprising:

a port rudder having a rudder stock rotatably affixed to the marine vehicle aft of a port propeller, said port rudders canted approximately 45° to the vertical;

a starboard rudder having a rudder stock rotatably affixed to the marine vehicle aft of a starboard propeller, said starboard rudder canted approximately 45° to the vertical, said port and starboard rudders having mutually opposite slopes;

a first rudder actuator mounted internally of the marine vehicle, said first rudder actuator coupled to said port rudder stock for providing a predetermined dynamic rotation to said port rudder;

a second rudder actuator mounted internally of the marine vehicle, said second rudder actuator coupled to said starboard rudder stock for providing a predetermined dynamic rotation to said starboard rudder;

a first power unit connected to said first and second rudder actuators for selectively providing power to one or both of said first and second rudder actuators;

a second power unit connected to said first and second rudder actuators for selectively providing power to one or both of said first and second rudder actuators; and a control unit for determining said predetermined dynamic rotation of said port and starboard rudders and for generating control signals corresponding thereto, said control signals being selectively provided to said power units for regulating said power provided to said actuator units wherein said control unit independently controls said dynamic rotation of said port and starboard rudders such that said dynamic rotations of said port and starboard rudders cooperate to provide steering control to the marine vehicle and to stabilize the marine vehicle against rolling and pitching motions.

15. A system as in claim 14 wherein each of said power units includes an electric servo-motor and a variable capacity hydraulic oil pump driven by said electric servo-motor for selectively providing a flow of hydraulic oil to said first and second rudder actuators, said electric servo-motor receiving said control signals from said control unit and regulating said flow of hydraulic oil provided to said rudder actuators in response thereto.

16. A system as in claim 15 wherein said control unit includes means for ascertaining marine vehicle dynamic motion data and for generating signals corresponding thereto, means for measuring rudder angular position and for generating signals corresponding thereto, and a controller for receiving a required heading signal and said signals from said ascertaining means and said measuring means, said controller generating said control signals in response to said received signals.

17. A system as in claim 16 wherein said means for ascertaining marine vehicle dynamic motion data include means for receiving data from a global positioning satellite system for determining sway amplitude and sway rate, and sensors for determining angles and rates of pitch, roll and yaw chosen from the group consisting of Watson meters, gyroscopes, accelerometers, compasses and combinations thereof, and wherein said controller, said ascertaining means, and said measuring means form a feedback loop for determining said dynamic rotation of said port and starboard rudders as a function of said angles and rates of pitch, roll and yaw, said rate and amplitude of sway, and said required heading.

18. A system as in claim 17 wherein said control unit places priority on said steering control during said determining of said dynamic rotation, and wherein said control unit is capable of selectively determining said dynamic rotation based on (a) said rates and angles of pitch and roll, said rate and amplitude of sway, and said required heading, (b) said rate and angle of pitch, said rate and amplitude of sway, and said required heading, or (c) said rate and angle of roll, said rate and amplitude of sway, and said required heading.

19. A system as in claim 18 further including a means for an operator to control said dynamic rotation of said port and starboard rudders independent of said system or in cooperation with said system.

* * * * *